US008529708B2

(12) United States Patent
Locke

(10) Patent No.: US 8,529,708 B2
(45) Date of Patent: Sep. 10, 2013

(54) CARBURIZED BALLISTIC ALLOY

(76) Inventor: Jay Carl Locke, Howell, MI (US)

( * ) Notice: Subject to any disclaimer, the term of this patent is extended or adjusted under 35 U.S.C. 154(b) by 130 days.

(21) Appl. No.: 12/979,169

(22) Filed: Dec. 27, 2010

(65) Prior Publication Data

US 2011/0197745 A1 Aug. 18, 2011

Related U.S. Application Data

(63) Continuation-in-part of application No. 11/876,510, filed on Oct. 22, 2007, now abandoned.

(51) Int. Cl.

| | |
|---|---|
| ***C23C 8/00*** | (2006.01) |
| *B21C 1/00* | (2006.01) |
| *C22C 38/40* | (2006.01) |

(52) U.S. Cl.
USPC ..... 148/206; 72/700; 72/701; 89/903; 148/210; 420/43

(58) Field of Classification Search
USPC ..... 72/700, 701; 79/700, 701; 420/43
See application file for complete search history.

(56) References Cited

U.S. PATENT DOCUMENTS

| | | | | |
|---|---|---|---|---|
| 1,457,101 | A | 5/1923 | Bradley et al. | |
| 1,563,420 | A | 12/1925 | Johnson et al. | |
| 2,161,162 | A * | 6/1939 | Harsch | 148/225 |
| 2,324,808 | A | 7/1943 | Abbott | |
| 2,395,688 | A * | 2/1946 | Selmi et al. | 420/104 |
| 2,438,759 | A | 3/1948 | Llebowitz | |
| 3,765,299 | A | 10/1973 | Pagano et al. | |
| 3,891,474 | A * | 6/1975 | Grange | 148/233 |
| 5,002,729 | A | 3/1991 | Wert et al. | |
| 5,749,140 | A | 5/1998 | Polito et al. | |
| 6,363,867 | B1 | 4/2002 | Tsilevich | |
| 6,503,340 | B1 | 1/2003 | Gold et al. | |
| 2004/0226170 | A1 | 11/2004 | Prucher | |
| 2004/0242337 | A1 | 12/2004 | Frana et al. | |
| 2005/0257860 | A1 * | 11/2005 | Takayama | 148/572 |

FOREIGN PATENT DOCUMENTS

WO WO 03080877 * 10/2003

* cited by examiner

*Primary Examiner* — Keith Walker
*Assistant Examiner* — Alexander Polyansky
(74) *Attorney, Agent, or Firm* — Gifford, Krass, Sprinkle, Anderson & Citkowski, P.C.

(57) ABSTRACT

A method for making armor plate that is resistant to armor piercing small arms ammunition is provided. The armor plate includes a steel plate having a nominal chemical composition in weight percent of 0.4C-1.8Ni-0.8Cr-0.25Mo. The steel plate is carburized on one side and produces a carburized side and a non-carburized side. The carburized side of the steel plate has a carbon concentration of at least 0.9% by weight and the non-carburized side has a carbon concentration of between 0.38 and 0.45% by weight. After the steel plate has been carburized, it is subsequently thermally processed such that the carburized side has a hardness of at least 58 Rockwell Hardness C (HRC), and the non-carburized side has a hardness of between >=50 and <=55 HRC.

13 Claims, 6 Drawing Sheets

CARBURIZED BALLISTIC ALLOY

CROSS REFERENCE TO RELATED APPLICATIONS

This application claims priority to U.S. patent application Ser. No. 11/876,510, filed Oct. 22, 2007, now abandoned, the entire contents of which are incorporated herein by reference.

FIELD OF THE INVENTION

The present invention in general relates to an armor plate, and in particular, an armor plate made from a carburized ballistic alloy.

BACKGROUND OF THE INVENTION

An armor plate can be a specially formulated hard steel plate used to cover warships, vehicles, and fortifications. The material is designed to resist penetration by bullets and other ballistic projectiles with the metallurgical structure designed to break or flatten and then capture the projectile, thereby preventing penetration therethrough. When used in mobile equipment such as vehicles, the size and weight of the armor plate can be critical. Therefore, armor plate having a relatively thin thickness and yet still possessing the capability to resist penetration by projectiles is desirable.

Armor piercing ammunition includes a bullet or projectile made from a hard material that is designed to penetrate armor plate. The hard material can be made from hardened steel, tungsten-carbide, or a depleted uranium penetrator enclosed with a softer metal, such as copper or aluminum. Armor piercing ammunition can range from rifle and pistol caliber rounds up to tank rounds. The ammunition used in rifles and pistols is typically built or designed around a penetrator of steel or tungsten. For example, armor piercing ammunition used in a rifle can include a steel or tungsten penetrator within a copper or cupro-nickel jacket that is similar to the jacket that would surround lead in a conventional projectile. Upon impacting a piece of armor plate, the copper or cupro-nickel jacket is destroyed, but the penetrator continues its motion in an attempt to penetrate the plate. Two examples of armor piercing ammunition for small arms include 7.62×63 M2AP (30 caliber armor piercing) weighing 166 grains and a 7.62×51 M61AP ammunition having a 0.308" diameter (30 caliber) projectile weighing 150.5 grains.

Given the availability of armor piercing ammunition for small arms, an economically produced armor plate that can resist armor piercing small arms ammunition fire would be desirable.

SUMMARY OF THE INVENTION

A method for making armor plate that is resistant to armor piercing small arms ammunition is provided. The armor plate includes a steel plate having a nominal chemical composition in weight percent of 0.4C-1.8Ni-0.8Cr-0.25Mo. The steel plate is carburized on one side and produces a carburized side and a non-carburized side. The carburized side of the steel plate has a carbon concentration of at least 0.9% by weight and the non-carburized side has a carbon concentration of between 0.38 and 0.45% by weight. After the steel plate has been carburized, it is subsequently thermally processed such that the carburized side has a hardness of at least 58 Rockwell Hardness C (HRC), and the non-carburized side has a hardness of >=50 and <=54 HRC.

A 6.35 millimeter (mm) (0.25 inch) thick steel plate carburized and thermally processed by a method disclosed herein can prevent full penetration of armor piercing small arms ammunition having a momentum not greater than 8.54 kg·m/s. In some instances, the steel plate is carburized using gas carburizing with a gas atmosphere having a carbon potential between 0.7 and 1.0.

DETAILED DESCRIPTION OF THE PREFERRED EMBODIMENTS

Figure 1:
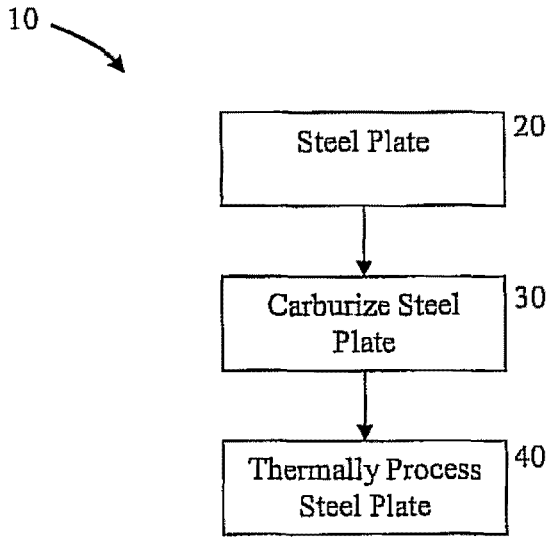
FIG. 1 is a flowchart illustrating an embodiment of the present invention.

The present invention includes a method for producing armor plate that is resistant to armor piercing small arms ammunition. As such, the method has utility for producing armor plate.

The method described herein includes taking a steel plate and carburizing one side of the plate, followed by thermally processing the material, in order to obtain a desired hardness on a carburized side of the plate and a desired hardness on the non-carburized side of the steel plate. In some instances, the steel plate is made from a steel designated as an AISI 4340 steel having a nominal composition measured in weight percent of 0.4C-1.8Ni-0.8Cr-0.25Mo. It is appreciated that for the purposes of the present invention, the nominal composition 0.4C-1.8Ni-0.8Cr-0.25Mo includes a steel having a composition (wt %) in the range of 0.38-0.44 C, 0.60-0.90 Mn, 0.15-0.35 Si, 0.65-0.90 Cr, 1.65-2.00 Ni, 0.20-0.30 Mo, 0.035 max P, 0.05 max S, 0.35 max Cu with the balance being Fe and other minor impurities in the steel from the melting process. It is also appreciated that this compositional range is the range of elemental compositions for the 4340 steel.

After the steel plate has been carburized on one side, the material is thermally processed such that the carburized side has a hardness of at least 57 Rockwell Hardness C (HRC) and the non-carburized side has a hardness of >=50 and <=55 HRC. In some instances, the carburized and thermally processed steel plate has a carburized side with a hardness of at least 58 HRC and a non-carburized side with a hardness of >=52 and <=55 HRC. In still other instances, the carburized side has a hardness of at least 60 HRC and the non-carburized side has a hardness of >=53 and <=55 HRC.

The thermal processing includes heating the carburized plate to between 1225 and 1275 degrees Fahrenheit (° F.) (663 and 691° C.) for a time between 15 to 45 minutes. Thereafter, the heated carburized plate can be heated to between 1525 and 1575° F. (829 and 857° C.) for a time between 10 and 30 minutes, followed by quenching of the steel plate in a molten salt to a temperature range between 325 and 375° F. (151 and 191° C.) for a time between 1 and 10 minutes. The steel plate is removed from the molten salt and allowed to air cool to room temperature after which it can be tempered at a temperature range between 350 and 400° F. (177 and 204° C.) for a time between 1 and 3 hours. After tempering, the plate is allowed to cool to room temperature by air-cooling or water quenching.

Referring now to FIG. 1, an embodiment shown generally at 10 is illustrated wherein a steel plate at step 20 is taken and carburized at step 30 and then thermally processed at step 40. The steel plate 20 can be made from any steel that affords for carburization and thermal processing such that a carburized side has a hardness of at least 57 HRC and a non-carburized side has a hardness of between 50 and 54 HRC. The plate can be carburized using any carburization method known to those skilled in the art, illustratively including gas carburization and pack carburization. If gas carburization is used to carburize the steel plate at step 30, then in some instances, the gas has a carbon potential of between 0.6 and 1.0. In other instances, the gas will have a carbon potential of between 0.7 and 0.9. The term carbon potential is defined for the purposes of the present invention as the partial pressure of the carbon depositing gas molecule(s) divided by the total pressure of the gas used in the gas carburizing process.

The steel plate can be carburized on one side by masking one of the sides of the plate such that carburization on that side does not occur. In the alternative, two steel plates can be placed back-to-back to each other and clamped and/or tack welded together such that the carbon containing gas does reach the back sides of the two plate sides, and thus the plate is carburized only on the outer side.

After the steel plate has been carburized, it can be thermally processed such that a desired hardness is obtained on the carburized side and/or the non-carburized side. It is appreciated, that steel having a higher hardness will also exhibit a higher strength and a lower ductility.

Figure 2:
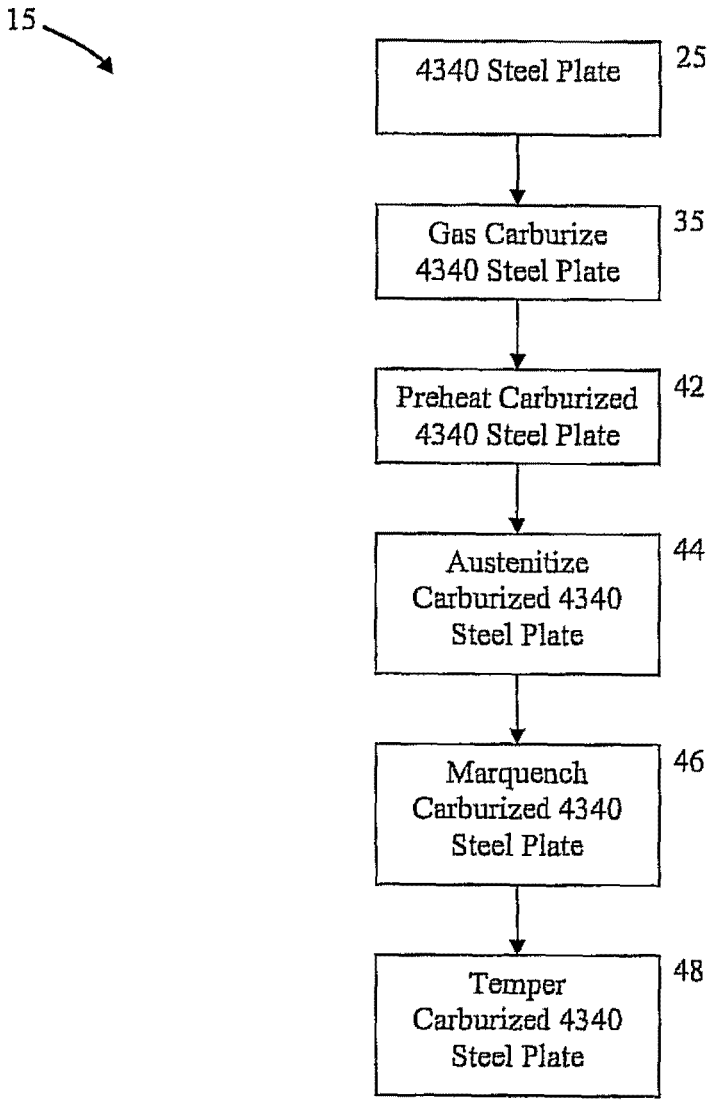
FIG. 2 is a flowchart illustrating another embodiment of the present invention.

Turning now to FIG. 2, another embodiment is shown generally at 15 wherein a flowchart illustrates a method for producing an armor plate from 4340 steel. The 4340 steel plate from step 25 is gas carburized at step 35. In some instances, the gas carburizing includes heating the steel plate in an enclosed chamber to between 1600 and 1800° F. (871 and 982° C.) and passing a carbonaceous gas having a carbon potential of between 0.7 and 0.9 through the enclosed chamber such that the gas contacts the steel plate. The steel plate can be heated to 1600-1800° F. (871-982° C.) for a time period of between 6 and 18 hours. In other instances, the steel plate can be heated to between 1650 and 1750° F. (899 and 954° C.) for 10 to 14 hours with the carburizing gas having a carbon potential of between 0.7 and 0.9 passing through the enclosed chamber. It is appreciated that during the gas carburizing process the steel plate within the enclosed processing chamber is exposed to a reducing gas atmosphere such that oxidation of the material does not occur or occurs at a negligible rate. It is also appreciated that the carbonaceous gas atmosphere having the above-stated carbon potential affords for the incorporation of carbon within the substrate of the steel plate and subsequent diffusion of the carbon into the material.

After the 4340 steel plate has been carburized at step 35, the material is taken and preheated at step 42. In some instances, the carburized steel plate is preheated to between 1225 and 1275° F. (663 and 691° C.) for a time period of between 15 to 45 minutes. After the preheat at step 42, the carburized 4340 steel plate is austenitized at step 44 by heating the steel plate to between 1525 and 1575° F. (829 and 857° C.) for a time period of between 10 and 30 minutes. After the austenization treatment at step 44, a marquench treatment to the steel plate is afforded by quenching the material in a molten salt to a temperature range of between 325 and 375° F. (151 and 191° C.) for a time period that allows for the equalization of the temperature for the entire piece of plate. In some instances, this time can be between 1 and 10 minutes. After the marquench treatment at step 46, the steel plate is removed from the molten salt and allowed to air cool to room temperature. If desired, the steel plate can then be tempered at step 48 by heating the material to between 350 and 400° F. (177 and 204° C.) for a time of between 1 and 3 hours. Thereafter, the steel plate is cooled to room temperature by air-cooling or water quenching.

Figure 3:
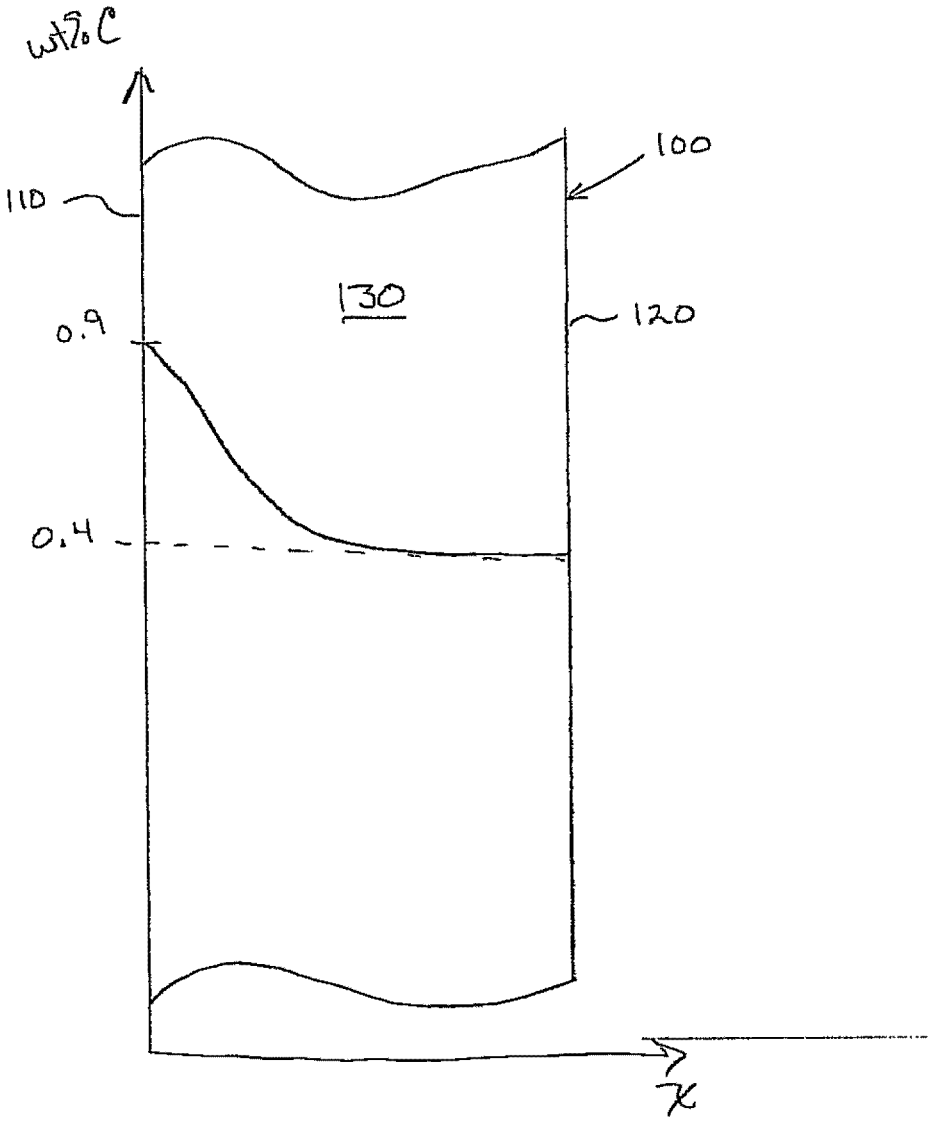
FIG. 3 is a graph showing the concentration of carbon as a function of depth within a steel plate processed according to an embodiment of the present invention, the graph schematically superimposed onto a cross-section of the steel plate.
Figure 4:
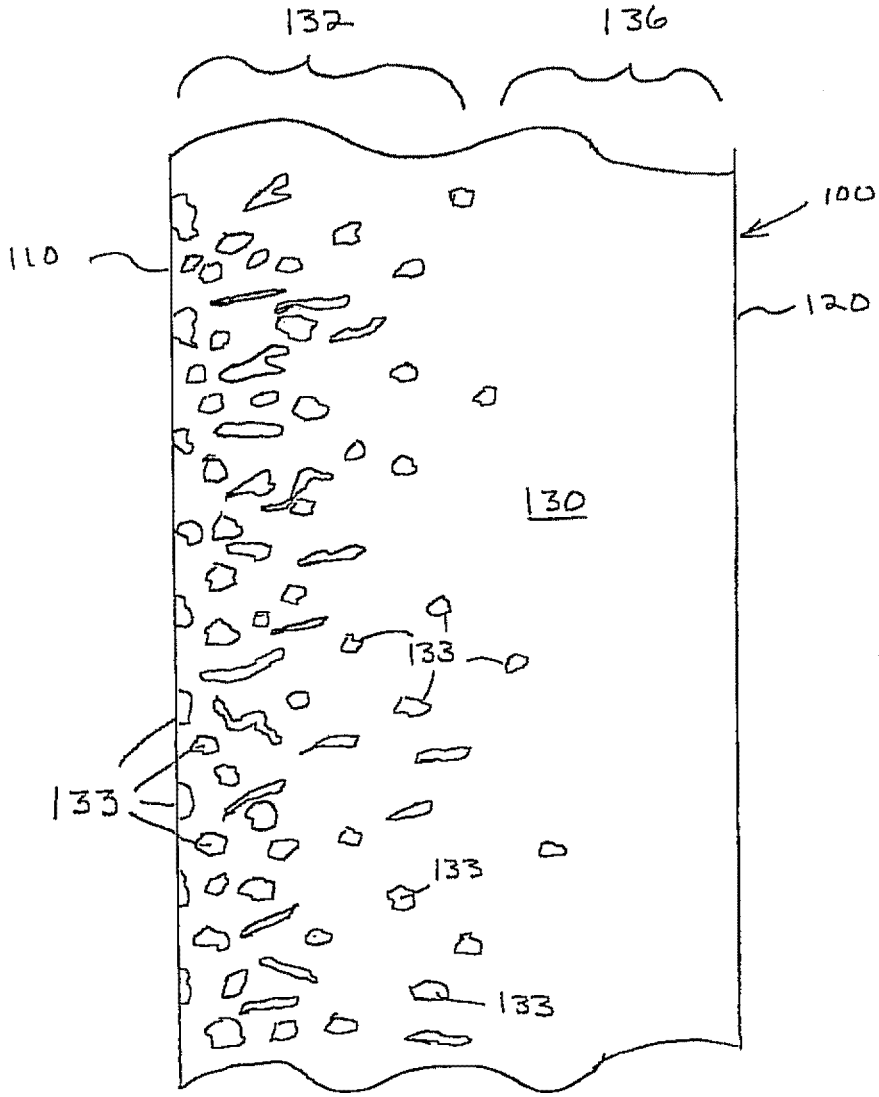
FIG. 4 is a cross-sectional view of a steel plate produced using an embodiment of the present invention illustrating the gradient of carbides therein.
Figure 5A:
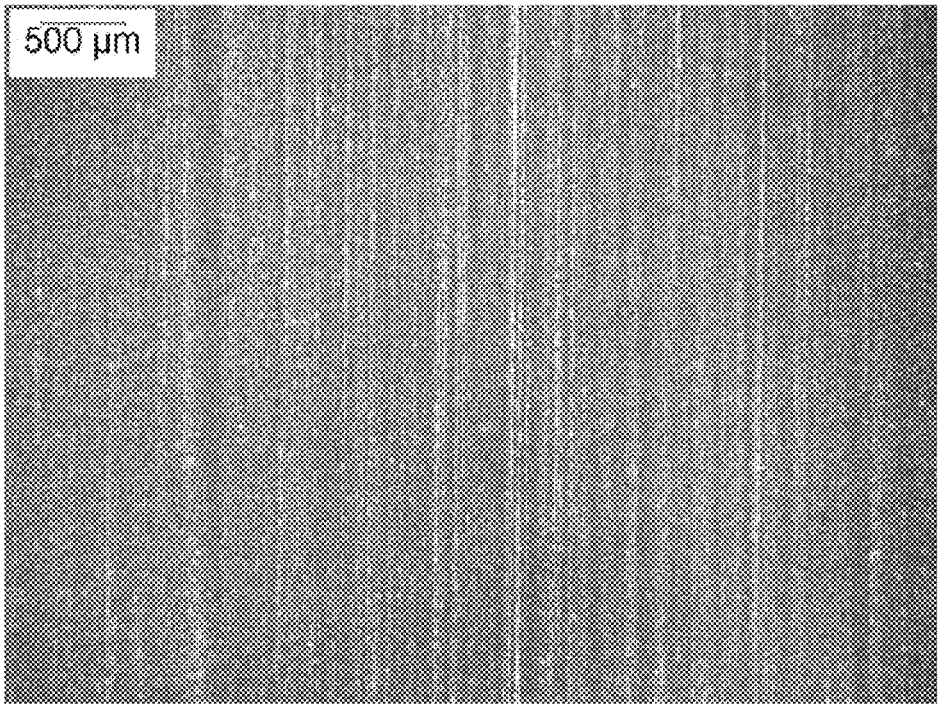
FIG. 5 is a series of photomicrographs illustrating an embodiment of the present invention.
Figure 5B:
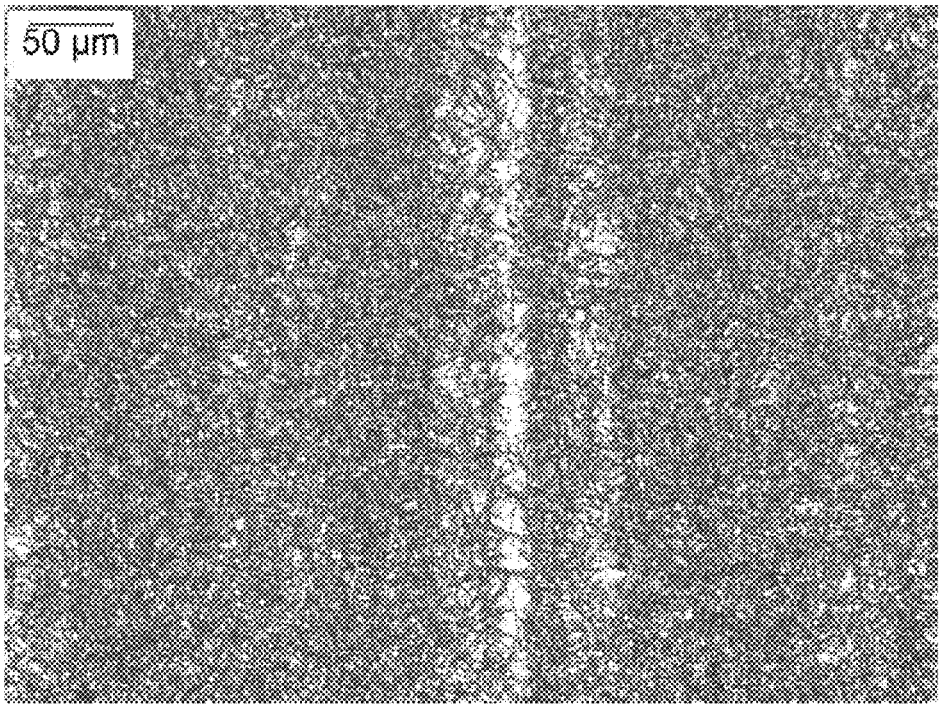
Figure 5C:
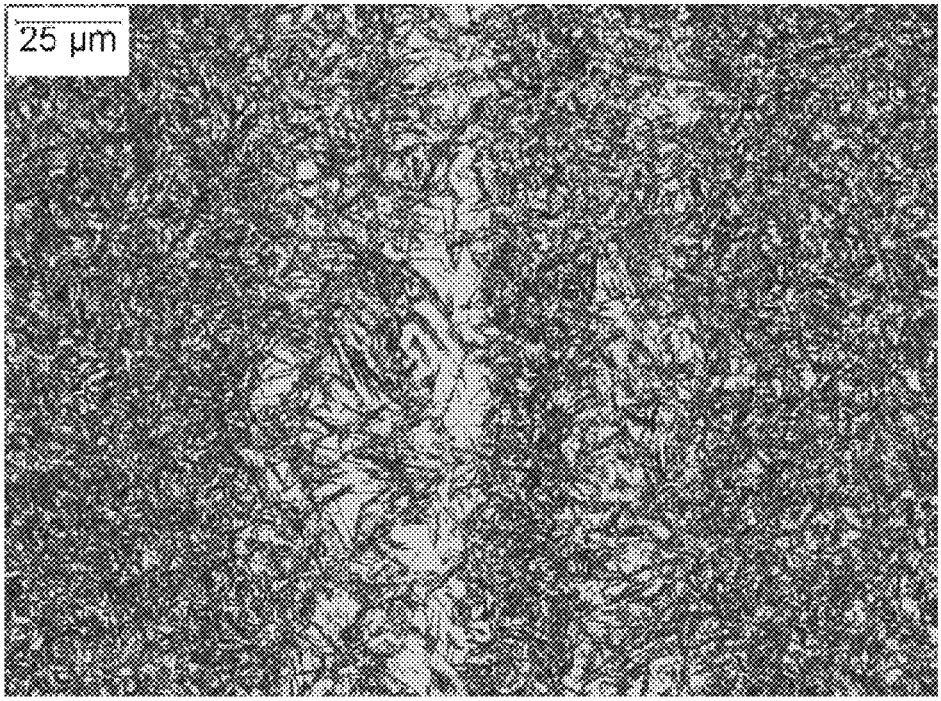
Figure 5D:
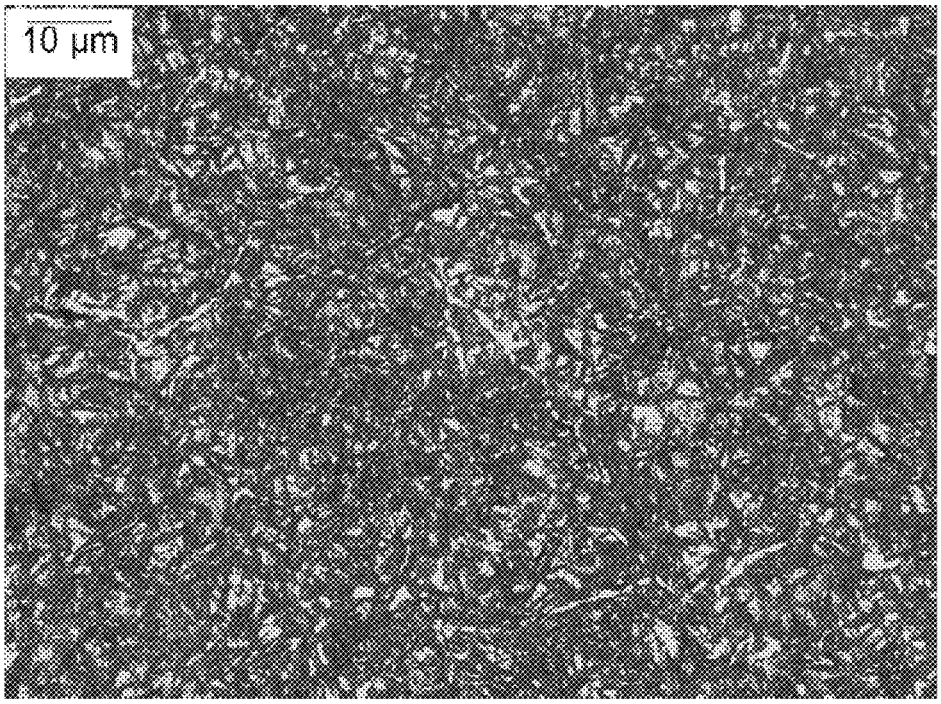

It is appreciated that the carburized side of the 4340 steel plate has a higher carbon content and thus a higher hardness than the non-carburized side. In addition, carbide precipitation will occur and be more populated proximate to the carburized side. Such an illustration is schematically shown in FIGS. 3 and 4 wherein FIG. 3 illustrates the concentration of carbon as a function of depth into a piece of 4340 steel plate that has been carburized on one side. As shown in FIG. 3, the graph showing the carbon concentration as a function of distance into the plate is superimposed onto the piece of 4340 steel plate. The plate 100 has a carburized side or surface 110 and a non-carburized side or surface 120. The substrate 130 has a concentration of carbon of approximately 0.9 weight percent proximate to the carburized side 110, the carbon concentration decreasing as a function of depth within the plate 100 until reaching the nominal composition of approximately 0.4 weight percent carbon. It is appreciated that this graph is for illustrative purposes only and is not necessarily accurate with respect to the exact concentration of carbon as a function of depth within the material. With the high concentration of carbon proximate to the carburized side 110 and the levels of carbide forming elements chromium and molybdenum within the 4340 steel plate 100, a gradient of carbide precipitates is present as schematically shown in FIG. 4. The substrate 130 has a carburized zone 132 and a non-carburized zone 136. The carburized zone 132 can have intergranular and/or intragranular $Cr_xMo_yC_z$ carbide precipitates where x can be zero or a positive value, y can be zero or a positive value and z is a positive value. The non-carburized zone 136 can include a microstructure of bainite and martensite. In addition, the carburized zone 132 can include bainite and martensite in addition to the carbide precipitates. It is appreciated that the carbon proximate to the carburized side 110 increases the hardness of the material due to solid solution hardening and/or the formation of the carbide precipitates. It is also appreciated that the high hardness of the carburized side can afford for deformation and blunting of an armor piercing projectile which thereby provides resistance to penetration of the carburized and thermally processed steel plate 100.

The method described results in a substantial increase in the performance of steel enabling the chosen material to be used as an effective ballistic armor. Without being limited to one particular theory, the principle performance increase is primarily due the formation of massive and network carbide structures within the material (to a depth of several millimeters) to the effect on the micro-structure changes that result from this process. Changes to the micro-structure can be described as consisting of lower bainite with substantial amounts of martensite. In the attached photomicrographs of FIGS. 5A-D, the bainite appears dark and the martensite appears white or light grey. The percentage of martensite varies from about 20 percent to about 50 percent of any field of inspection at 500×, visually estimated. The concentration of martensite is especially great in longitudinal bands near the centerline of the plate.

In FIGS. 5 A-D the plate is carburized on one side, and the case depth is not apparent in the microstructure which is a mixture of bainite and martensite in both the case and core. However, massive and network carbides are visible in the case, features generally are not desired in a carburized case. Carbides exist to a depth of several millimeters below the carburized surface and enhance the ballistic performance of the material. In addition to the expected increase of the hardness of the base material due to the carburizing process, the presence of a network of carbides on one surface of the material while simultaneously maintaining base material properties on the side opposite provides the principle performance increase. The presence of carbides to a depth of several millimeters in addition to the bainite and martensite layers result in a material with a stratified hardness layer while the base material properties on the side opposite result in malleable surface with base material elongation, sheer and tensile strength.

This process can be used to enhance the ballistic properties any of several steel grades and is not restricted to 43XX materials. Illustrative examples of grades of steel operable include: 4120; 5120; 8620/8720; 4720; 4320; 3310/3311; CBS-6000; CBS-50 Nil; or (any of a multitude of) similar tool steels. The Ballistic performance enhancement is expected with any steel chosen that results in a formation of surface carbides, a stratified hardness and a substantially unchanged base material side opposite. A wide variety of Ballistic enhancements is attained through base material selection so as to provide the end user with a selection of materials based upon cost, weight and protection level desired.

In an effort to better teach the method described herein, an example of the use of the method and subsequent results is provided below.

EXAMPLE

A piece of 6.35 mm (0.25 inch) thick 4340 steel plate with an initial spheroidized annealed microstructure having a hardness of approximately 21 HRC was, carburized using a gas carburizing treatment. The 4340 steel plate was placed in an electric pit furnace and heated to 1700° F. (927° C.) for 12 hours while a reducing carbon containing gas having a carbon potential of between 0.8-0.9 was passed through the furnace. One side of the 4340 steel plate was masked such that it was not be carburized. After the carburizing treatment, the mask medium on the one side was removed and the steel plate thermally processed.

Thermal processing of the carburized plate included preheating the steel plate to 1250° F. (677° C.) for 30 minutes, followed by heating of the plate to 1550° F. (843° C.) for 20 minutes. Thereafter, the steel plate was quenched in molten salt to a temperature of 350° F. (177° C.) and then allowed to, air cool to room temperature. Then, the steel plate was tempered at 350°-400° F. (177-204° C.) for two hours and allowed to cool at room temperature. Hardness readings of the steel plate were taken on the carburized side and the non-carburized side. The carburized side had an average hardness of 58.8 HRC and the non-carburized side had an average hardness of 54.2 HRC.

In addition to hardness testing, tensile samples were prepared from the plate and subjected to mechanical testing with the results shown in the table below.

| Sample ID | Ultimate Tensile Strength (MPa) | Yield Strength (0.2% Offset) (MPa) | Elongation (% in 2") |
|---|---|---|---|
| 1A | 1620 | 1227 | 1.0 |
| 1B | 1689 | 1151 | 2.4 |
| 1C | 1524 | 1186 | 2.0 |

As shown by this table, samples from the carburized and thermally processed 4340 steel plate exhibited high strength and low ductility.

A chemical analysis of the carburized side and non-carburized side was also obtained using glow discharge-optical imaging spectroscopy with the results provided in the table below.

| Element | Carburized Side (wt %) | Non-Carburized Side (wt %) |
|---|---|---|
| C | 0.99 | 0.45 |
| Si | 0.27 | 0.27 |
| Mn | 0.78 | 0.79 |
| Cr | 0.82 | 0.83 |
| Ni | 1.79 | 1.84 |
| Mo | 0.23 | 0.23 |
| Fe | base | base |

As illustrated in the table, the carburized side has a relatively high carbon concentration due to the carburizing treatment.

The carburized 4340 steel plate, after thermal processing, was also examined for microstructure characteristics. A sample from the plate was mounted and polished using standard metallographic techniques. The base microstructure consisted of lower bainite with substantial amounts of martensite. Proximate to the carburized side, massive and network carbides, also known as intragranular and intergranular carbides, were visible.

The 6.35 mm (0.25 inch) thick carburized and thermally processed 4340 steel plate was ballistic tested per STANAG 4569 annex A using 7.62×51 M61AP (30 caliber armor piercing) projectiles up to 2864 feet per second (873 m/s). at a target angle of 0 deg's obliquity. The firing of the projectiles upon the carburized and thermally processed 4340 steel plate resulted in no penetration therethrough of the witness plate when using a prescribed spall shield. The resultant V50 of 2864 feet per second (873 m/s) as tested per MIL-STD-662F-V50 Ballistic test for armor. In contrast, the firing of .223 caliber 55 gr. M193 at velocities of 3100 feet per second (945 m/s) at a piece of 4340 steel plate having a hardness of approximately 56 HRC did result in penetration therethrough. Repeated impacts within 3 cm of the first impact are also prevented from penetrating. In addition, 4340 steel plate that had been processed such that it had a through hardness of approximately 60 HRC fractured in a brittle fashion when fired upon with .223 caliber 55 gr. M193 projectiles above 3000 feet per second (914 m/s).

The 7.62×51 M61AP (30 caliber armor piercing) projectiles had a mass of 151 grains, thus having a momentum of 8.54 k·m/s when traveling at 2864 feet per second (873 m/s). Therefore, the method of the present invention affords for an armor plate that is resistant to 7.62×51 M61AP (30 caliber armor piercing) projectiles having a momentum up to 8.54 kg·m/s at impact.

It is to be understood that various modifications are readily made to the embodiments of the present invention described herein without departing from the spirit and scope thereof.

For example, any steel plate having a carbon concentration gradient from a high C side to a low C side that exhibits a hardness on the high C side of at least 58 HRC and a hardness on the low C side between >=53 and <=55 HRC, the steel plate having a thickness of 6.35 mm (0.25 inch) and being resistant to projectiles described in STANAG 4569 Annex A up to and including those described as Level 3 threats are included within the scope of the present invention. Additionally, a plurality of thickness' of any steel plate or laminations made up from a plurality of thickness' of any steel plate with individual steel sheets or plates having a carbon concentration gradient from a high C side to a low C side that exhibits a hardness on the high C side of at least 58 HRC and a hardness on the low C side between >=50 and <=55 HRC used for resistance to projectiles described in STANAG 4569 Annex A up to and including those described as Level 5 threats are included without departing from the spirit and scope thereof. Preferably, a laminate of two or more inventive sheets are oriented with the roll direction of the steel that is angularly offset. By way of example, a first sheet has a vertical roll direction while an adjacent second sheet has horizontal roll direction and a third sheet behind the second sheet has a roll direction of something other than horizontal such as 45 degrees from horizontal or vertical. Optionally, a spall liner is provided in opposition with the plate side receiving projectile impact.

In some instances the 6.35 mm (0.25 inch) thick steel plate would: (1) prevent penetration of 7.62×51 M61AP (30 caliber armor piercing) ammunition traveling at 2864 ft/s (873 m/s); (2) have a high C side or surface with a composition within the range (wt %) of C>0.8, 0.3-2.0 Mn, 0.40-9.0 Cr, 0.1-10.0 Ni, 0.01-2.0 Mo, balance Fe (with other incidental impurities) with a hardness of greater than 58 HRC; (3) have a low C side or surface with a composition within the range (wt %) of C<0.5, 0.3-2.0 Mn, 0.1-0.5 Si, 0.40-9.0 Cr, 0.1-10.0 Ni, 0.01-2.0 Mo, balance Fe (with other incidental impurities) with a hardness of between >=53 and <=55 HRC; and (4) have a C concentration gradient from the high C surface to the low C surface.

In other instances the 6.35 mm (0.25 inch) thick steel plate would: (1) prevent orthogonal penetration of 7.62×51 M61AP (30 caliber armor piercing) ammunition traveling at 2864 ft/s (873 m/s); (2) have a high C side or surface with a composition within the range (wt %) of C>0.9, 0.60-0.90 Mn, 0.15-0.35 Si, 0.70-0.90 Cr, 1.65-2.00 Ni, 0.20-0.30 Mo, 0.015 max P, 0.015 max S, 0.35 max Cu, balance Fe (with other incidental impurities) with a hardness of greater than 58 HRC; (3) have a low C side or surface with a composition within the range (wt %) of C<0.5, 0.60-0.90 Mn, 0.15-0.35 Si, 0.70-0.90 Cr, 1.65-2.00 Ni, 0.20-0.30 Mo, 0.015 max P, 0.015 max S, 0.35 max Cu, balance Fe (with other incidental impurities) with a hardness of between >=53 and <=55 HRC; and (4) have a C concentration gradient from the high C surface to the low C surface.

Accordingly, it is to be understood that the invention is not to be limited by the specific illustrated embodiment, but by the scope of the appended claims.

I claim:

1. A method for making armor plate resistant to armor piercing small arms ammunition, the method comprising:

providing a steel plate having a thickness and a nominal chemical composition in weight percent of 0.38-0.44 C, 1.65-2.00 Ni, 0.65-0.90 Cr, 0.20-0.30 Mo, 0.15-0.35 Si, 0.60-0.85 Mn, P less than or equal to 0.035, S less than or equal to 0.05, balance Fe and other incidental impurities;

carburizing one side of the steel plate to produce a carburized plate having a carburized side and a non-carburized side, the carburized side of the steel plate having a carbon concentration of at least 0.9 percent by weight and the non-carburized side having a carbon concentration of between 0.38 and 0.45 percent by weight, and heating the carburized plate at a temperature range between 1225 and 1275 degrees Fahrenheit for a time between 15 to 45 minutes and thereafter heating the carburized plate at a temperature range between 1525 and 1575 degrees Fahrenheit for a time between 10 and 30 minutes.

2. The method of claim 1, further comprising the step of thermal processing the carburized steel plate such that the carburized side has a hardness of at least 58 Rockwell hardness C and the non-carburized side has a hardness >=53 and <=55 Rockwell hardness C.

3. The method of claim 1, wherein the carburizing includes gas carburizing.

4. The method of claim 3, wherein a gas used in the gas carburizing has a carbon potential between 0.7 and 1.0.

5. The method of claim 4, wherein the gas carburizing includes heating the steel plate to an elevated temperature, the elevated temperature being between 1600 and 1800 degrees Fahrenheit.

6. The method of claim 5, wherein the elevated temperature is between 1650 and 1750 degrees Fahrenheit.

7. The method of claim 5, wherein the steel plate is heated at the elevated temperature for a time between 6 and 18 hours.

8. The method of claim 5, wherein the steel plate is heated at the elevated temperature for a time between 10 and 14 hours.

9. The method of claim 1 further comprising:

subsequent to said step of heating, quenching the carburized plate in molten salt to a temperature range between 325 and 375 degrees Fahrenheit for a time between 1 and 10 minutes; and removing the carburized plate from the molten salt and allowing it to air cool to room temperature;

reheating the carburized plate at a temperature range between 350 and 400 degrees Fahrenheit for a time between 1 and 3 hours; and air cooling the carburized plate to room temperature.

10. The method of claim 1, wherein the carburizing includes gas carburizing.

11. The method of claim 10, wherein a gas used in the gas carburizing has a carbon potential between 0.7 and 1.0.

12. The method of claim 11, wherein the elevated temperature is between 1650 and 1750 degrees Fahrenheit.

13. The method of claim 12, wherein the steel plate is heated at the elevated temperature for a time between 10 and 14 hours.

* * * * *